US008715039B2

(12) United States Patent
Chen

(10) Patent No.: US 8,715,039 B2
(45) Date of Patent: May 6, 2014

(54) MACHINE TOOL PROVIDING A LARGE GRINDING AREA

(75) Inventor: Bach Pangho Chen, Claremont, CA (US)

(73) Assignee: X'Pole Precision Tools Inc., Zhongli, Taoyuan County (TW)

( * ) Notice: Subject to any disclaimer, the term of this patent is extended or adjusted under 35 U.S.C. 154(b) by 239 days.

(21) Appl. No.: 13/305,048

(22) Filed: Nov. 28, 2011

(65) Prior Publication Data

US 2013/0137347 A1 May 30, 2013

(51) Int. Cl.

| | |
|---|---|
| ***B24B 27/08*** | (2006.01) |
| ***B24B 27/00*** | (2006.01) |
| ***B24B 23/02*** | (2006.01) |

(52) U.S. Cl.

CPC ..... *B24B 27/00* (2013.01); *B24B 27/0076* (2013.01); *B24B 23/02* (2013.01)

USPC ..... 451/353; 451/350

(58) Field of Classification Search

CPC .... B24B 27/00; B24B 27/0076; B24B 23/00; B24B 23/02

USPC ..... 451/353, 359, 259, 344, 350

See application file for complete search history.

(56) References Cited

U.S. PATENT DOCUMENTS

| | | | | | |
|---|---|---|---|---|---|
| 1,591,997 | A | * | 7/1926 | Pond | 451/353 |
| 1,654,275 | A | * | 12/1927 | Strand | 15/230 |
| 1,928,390 | A | * | 9/1933 | Myers | 451/353 |
| 1,932,319 | A | * | 10/1933 | Myers | 451/353 |
| 1,988,193 | A | * | 1/1935 | Edstrom | 451/353 |
| 2,480,739 | A | * | 8/1949 | Johnson | 15/28 |
| 2,877,775 | A | * | 3/1959 | Hall | 132/73.6 |
| 2,923,107 | A | * | 2/1960 | Biasoni | 451/353 |
| 3,102,372 | A | * | 9/1963 | Vezner | 451/353 |
| 3,522,679 | A | * | 8/1970 | Sundberg | 451/36 |
| 3,594,958 | A | * | 7/1971 | Cusumano | 451/358 |
| 3,631,635 | A | * | 1/1972 | Vezner | 451/353 |
| 4,155,596 | A | * | 5/1979 | Brejcha | 299/40.1 |
| 4,219,898 | A | * | 9/1980 | Presby | 15/49.1 |
| 4,295,274 | A | * | 10/1981 | Bricher et al. | 30/347 |
| 4,328,645 | A | * | 5/1982 | Sauer | 451/359 |

(Continued)

FOREIGN PATENT DOCUMENTS

| | | |
|---|---|---|
| TW | 339718 | 9/1998 |

*Primary Examiner* — Lee D Wilson
*Assistant Examiner* — Tyrone V Hall, Jr.
(74) *Attorney, Agent, or Firm* — Muncy, Geissler, Olds & Lowe, P.C.

(57) ABSTRACT

A machine tool providing a large grinding area includes a tool body, a rotary bracket driven by the tool body and a plurality of grinding portions coupled to the rotary bracket. The tool body includes a driving motor and a spindle driven by the driving motor to spin axially. The rotary bracket is coupled to and driven by the spindle to rotate and includes a plurality of connecting portions equally spaced from each other on the circumference formed by rotation of the rotary bracket. The grinding portions are coupled with the connecting portions and have grinding zones at the same horizontal level and are driven by the rotary bracket to rotate synchronously therewith to jointly form a grinding plane. Thereby a larger grinding area can be achieved through smaller grinding discs.

9 Claims, 5 Drawing Sheets

(56) References Cited

U.S. PATENT DOCUMENTS

| | | | | |
|---|---|---|---|---|
| 4,673,311 | A * | 6/1987 | Whiteman, Jr. | 404/112 |
| 4,709,510 | A * | 12/1987 | Giovanni et al. | 451/353 |
| 5,372,452 | A * | 12/1994 | Hodgson | 404/112 |
| 5,403,231 | A * | 4/1995 | Duckworth | 451/344 |
| 8,366,518 | B2 * | 2/2013 | Bailey | 451/357 |
| 2004/0082285 | A1 * | 4/2004 | Bohler | 451/359 |
| 2006/0025059 | A1 * | 2/2006 | Gueorguiev et al. | 451/350 |
| 2006/0083589 | A1 * | 4/2006 | McClain | 404/112 |

* cited by examiner

MACHINE TOOL PROVIDING A LARGE GRINDING AREA

FIELD OF THE INVENTION

The present invention relates to a grinding apparatus and particularly to a surface grinding apparatus capable of grinding in a large area.

BACKGROUND OF THE INVENTION

During surface grinding operation, a machine tool which commonly includes an electric motor and a grinding disc is usually used. The grinding disc holds mating sandpaper at the bottom thereof. The electric motor drives the grinding disc rotating at a high speed to allow the sandpaper to grind the surface of a targeted object. In general, the grinding disc and the mating sandpaper are formed in common sizes of 3, 5 and 6 inches. These grinding disc and sandpaper are available on the market and cost at affordable levels. The sandpaper is diversified in specification and material to meet different requirements of users and grinding operation.

However, for the larger area grinding operation (such as tabletop, wall surface, ground surface and the like), the grinding disc and sandpaper at the common dimension do not have large enough diameters to provide only limited grinding area, hence operation speed is slower and efficiency is lower. In response to surface grinding work of a larger area a machine tool providing a larger grinding area is needed. For instance, R.O.C. Pat. publication No. 339718 entitled "Disc structure for Nylon fiber grinding wheels of a larger area disc" provides a disc structure of Nylon fiber grinding wheels for a handheld grinder capable of grinding a larger area at a higher efficiency. The disc is made from plastics integrally by injection and has desired flexibility. It has a hexagonal screwing seat extended from the center of the top surface. The screwing seat has a hole run though vertically from the top end thereof to the bottom side of the disc. A hexagonal nut is embedded in the hole close to the top end. It can be easily installed and removed from the handheld grinder. Moreover, the screwing seat has a circumference at the bottom end with an annular rib formed thereon and jutting towards the disc to bear the torsional force loaded onto the grinder at high rotational speed without breaking the disc. It can perform grinding work of a larger grinding area faster.

However, the aforesaid conventional machine tool requires the grinding disc and the mating sandpaper with larger specifications but not the common specifications, they are difficult to acquire and usually are expensive even if available. Moreover, materials and specifications of the sandpaper also are varying without sufficient selections. It still leaves a lot to be desired in terms of improving grinding work efficiency of a large area and costs. There is still room for improvement.

SUMMARY OF THE INVENTION

The primary object of the present invention is to solve the problem of the conventional machine tools that cannot provide desired work efficiency of large area grinding at a lower cost.

To achieve the foregoing object, the present invention provides a machine tool for grinding a large area. It includes a tool body, a rotary bracket driven by the tool body and a plurality of grinding portions coupled to the rotary bracket. The tool body includes a driving motor and a spindle driven by the driving motor to spin axially. The rotary bracket is coupled to and driven by the spindle to rotate and includes a plurality of connecting portions equally spaced from each other on the circumference formed by rotation of the rotary bracket. The grinding portions have grinding zones at the same horizontal level and are driven by the rotary bracket to rotate synchronously therewith to jointly form a grinding plane. Therefore it can provide grinding for a larger size through smaller grinding discs.

In one aspect the tool body includes a hood to cover the grinding portions.

In another aspect the hood has a dust discharge port.

In yet another aspect the rotary bracket includes a vane set located on each of the connecting portions.

In yet another aspect the spindle has a first coupling portion and the rotary bracket has a second coupling portion fastened to the first coupling portion.

In yet another aspect the first coupling portion and the second coupling portion are thread structures corresponding to each other.

In yet another aspect the grinding portions are formed at the same diameter.

In yet another aspect the grinding portions are formed at the same weight.

In yet another aspect each grinding portion has a sandpaper located on each grinding zone.

The invention provides a plurality of smaller grinding discs to replace a larger grinding disc. When the smaller grinding discs are driven by the spindle to rotate and the grinding zones are driven to rotate synchronously, a grinding plane is jointly formed to increase grinding area for a larger area grinding operation. With the grinding portions formed at the same weight and size, and spaced from the spinning center at the same distance, the grinding portions become balance weights relative to each other so that the machine tool can operate smoothly in a balanced manner. The distance between the grinding portions and spinning center is greater than that of the conventional grinding tools, thus the invention can perform grinding operation at high speed and increase grinding efficiency.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
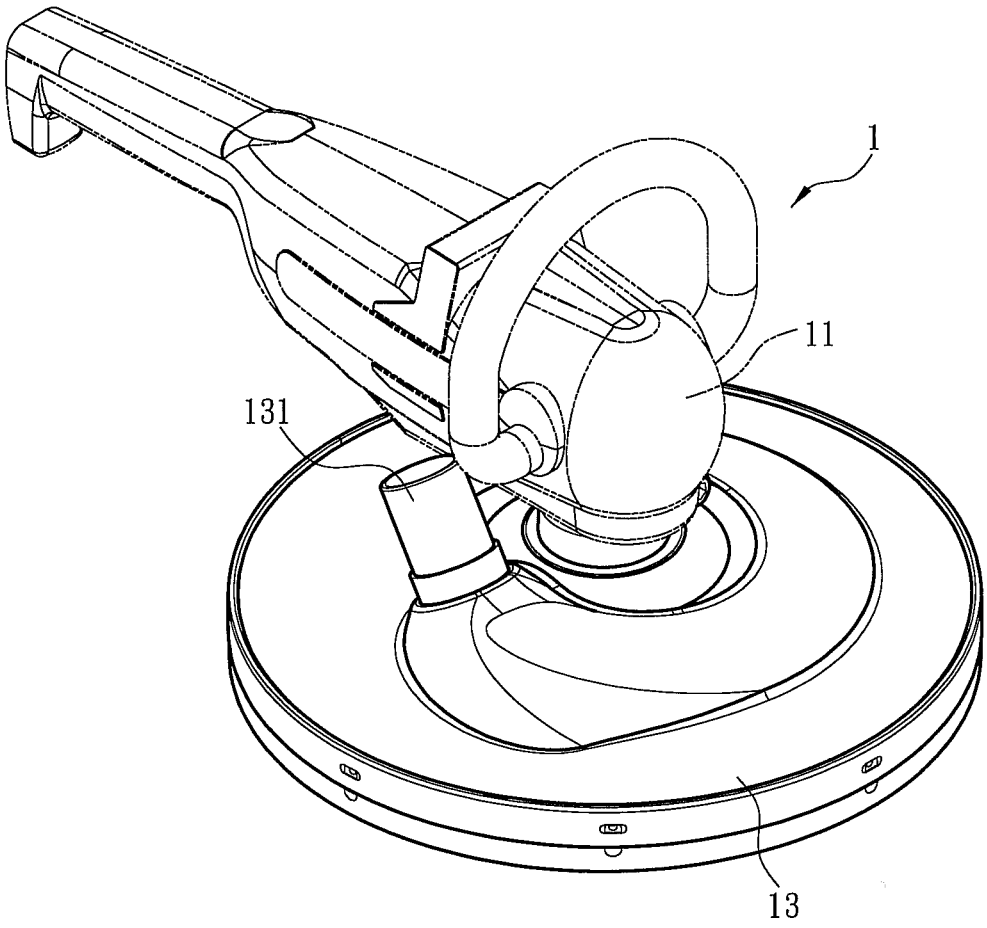
FIG. 1 is a top perspective view of the machine tool providing a large grinding area according to the invention.
Figure 2:
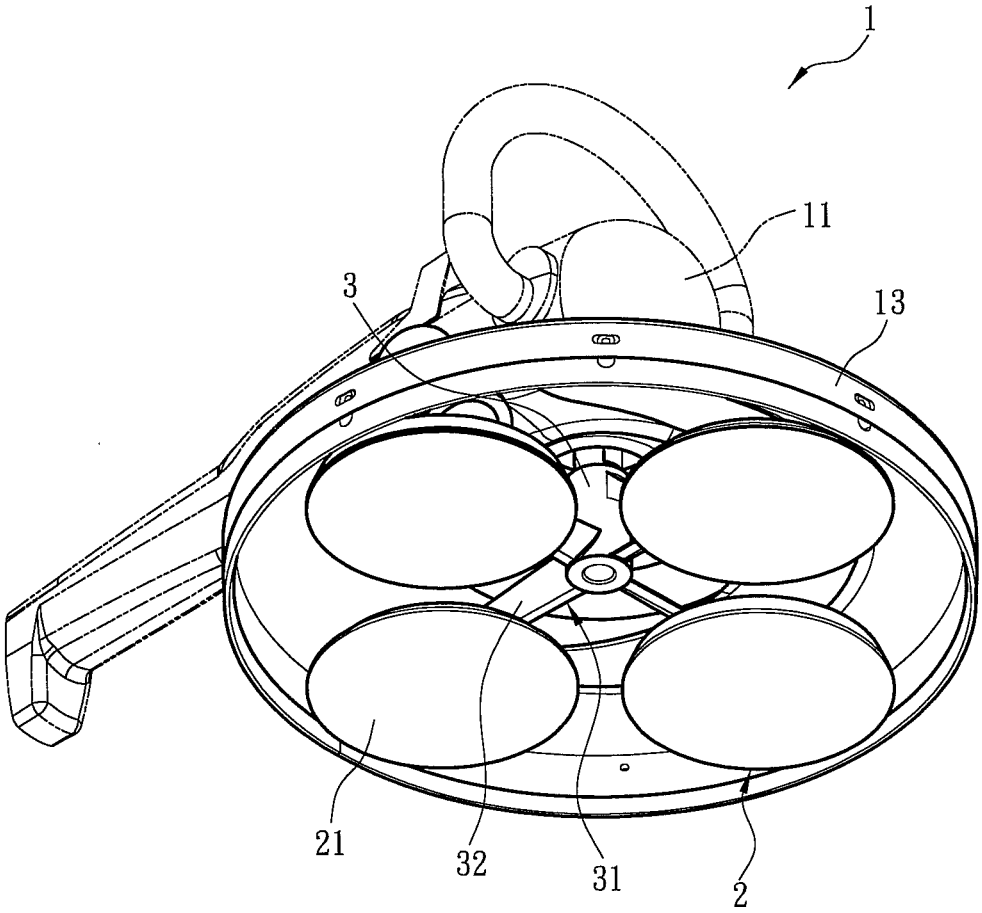
FIG. 2 is a perspective view of the machine tool according to the invention seen from the bottom.
Figure 3:
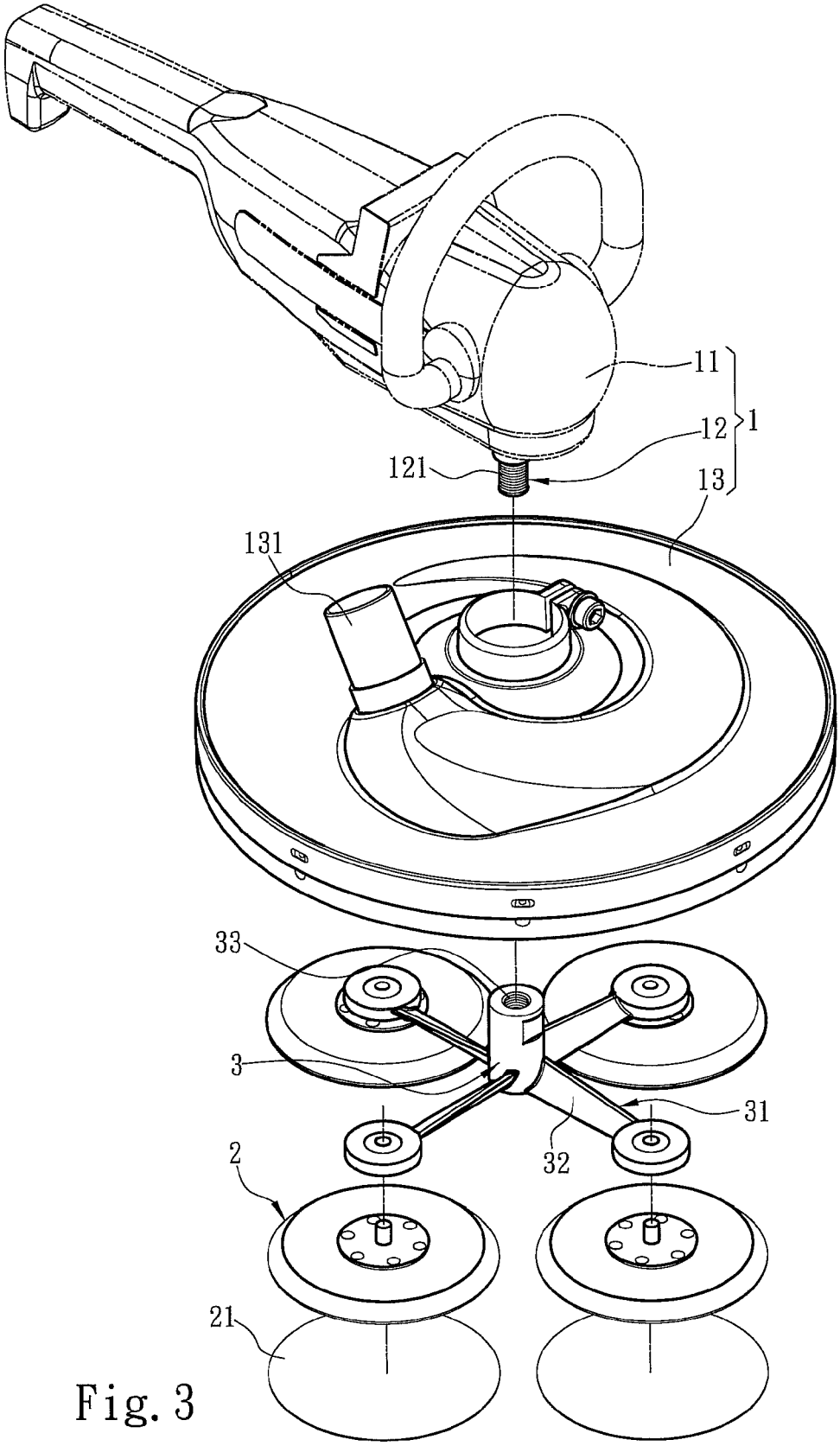
FIG. 3 is an exploded view of the invention.

Please refer to FIGS. 1, 2 and 3, the present invention aims to provide a machine tool with a large grinding area. It includes a tool body 1, a rotary bracket 3 driven by the tool body 1 and a plurality of grinding portions 2 coupled to the rotary bracket 3. The tool body 1 includes a driving motor 11 and a spindle 12 driven by the driving motor 11 to spin axially. The rotary bracket 3 is coupled to and driven by the spindle 12 to rotate and includes a plurality of connecting portions 31 equally spaced from each other on the circumference formed by rotation of the rotary bracket 3. The grinding portions 2 are coupled to the connecting portions 31 and have grinding zones 21 at the same horizontal level and are driven by the rotary bracket 3 to rotate synchronously therewith to jointly form a grinding plane 4 (referring to FIG. 4).

The tool body 1 further includes a hood 13 to cover the grinding portions 2. During grinding operation dusts are generated and can be gathered in the hood 13 without spreading to the ambience. The hood 13 has a dust discharge port 131 which can be connected to a dust suction device (not shown in the drawings) to suck out the dusts gathered in the hood 13. The rotary bracket 3 includes a vane set 32 located on each of the connecting portions 31. When the tool body 1 drives the grinding portions 2 rotating, the vane sets 32 also rotate at the same time like the vane of a general electric fan to blow the dust generated during grinding upwards. The spindle 12 has a first coupling portion 121, and the rotary bracket 3 has a second coupling portion 33 fastened to the first coupling portion 121. In this embodiment, the first and second coupling portions 121 and 33 are mating thread structures, but this is not the limitation of the invention. The grinding portions 2 are symmetrical and formed at the same weight and same diameter to become balance weights with each other. Each grinding portion 2 has a sandpaper located on each grinding zone 21. The sandpaper is formed at a common specification and material, and can be easily acquired on the market at an inexpensive price.

Figure 4:
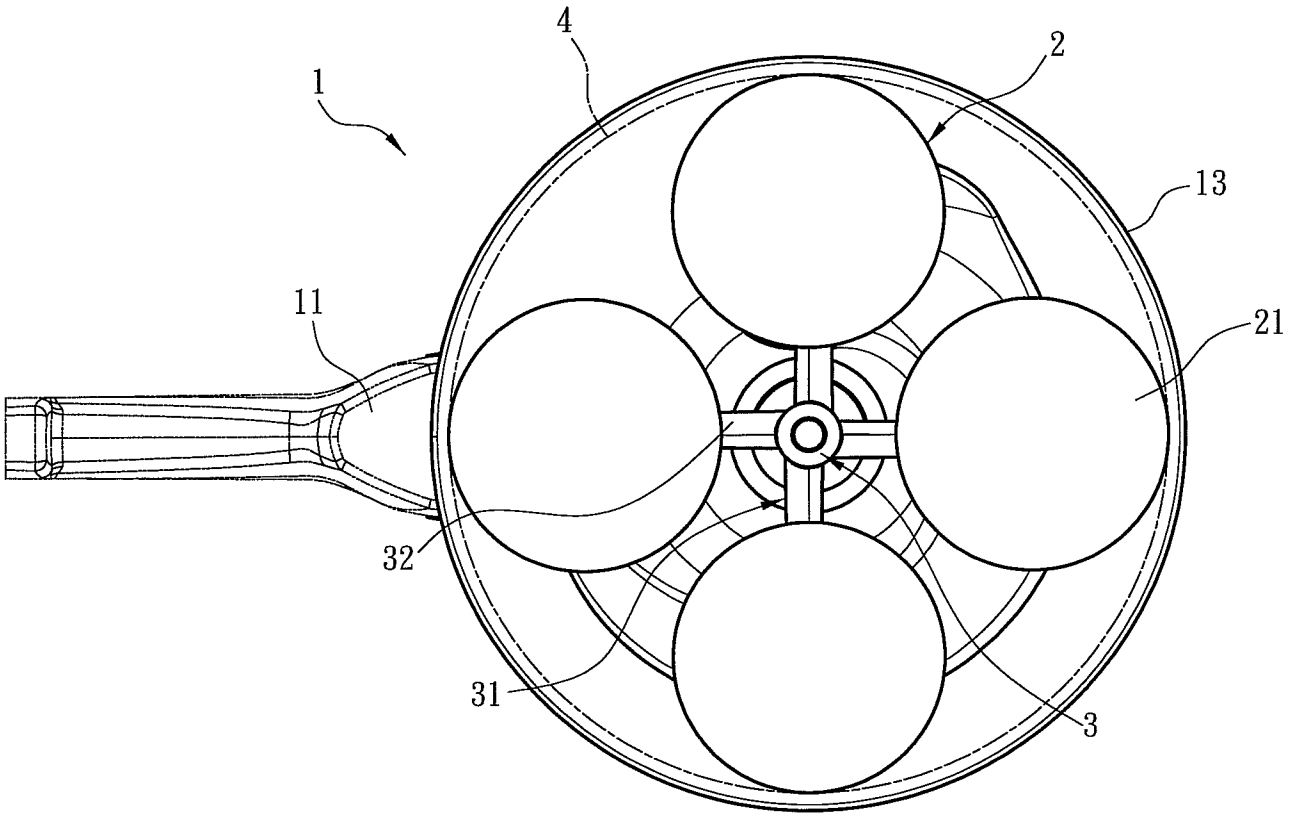
FIG. 4 is a schematic view of the invention showing a grinding zone.

Referring to FIGS. 3 and 4, when in use, the rotary bracket 3 is coupled with the tool body 1 and grinding portions 2. When the driving motor 11 of the tool body 1 drives the spindle 12 spinning axially, the grinding portions 2 are driven by the spindle 12 to rotate coaxially. The driving motor 11 can be a pneumatic motor or electric motor. The grinding portions 2 include the grinding zones 21 at the same horizontal level. When the grinding portions 2 are driven by the spindle 12 to rotate, the grinding zones 21 also rotate synchronously to form the grinding plane 4. The rotary bracket 3 increases the distance between the grinding portions 2 and the spinning center. For instance, given each grinding zone 21 a diameter of 5 inches, and the distance between the grinding zone 21 and the spinning center is 100 mm; in other words, the grinding portions 2 rotate on a track with a diameter of 200 mm, thus is much greater than that of 2.5 to 10 mm of the general grinders. Hence the invention provides a much larger grinding area. The larger the track diameter of the machine tool, the stronger the grinding force, and the faster the grinding speed, hence grinding efficiency also improves.

Figure 5:
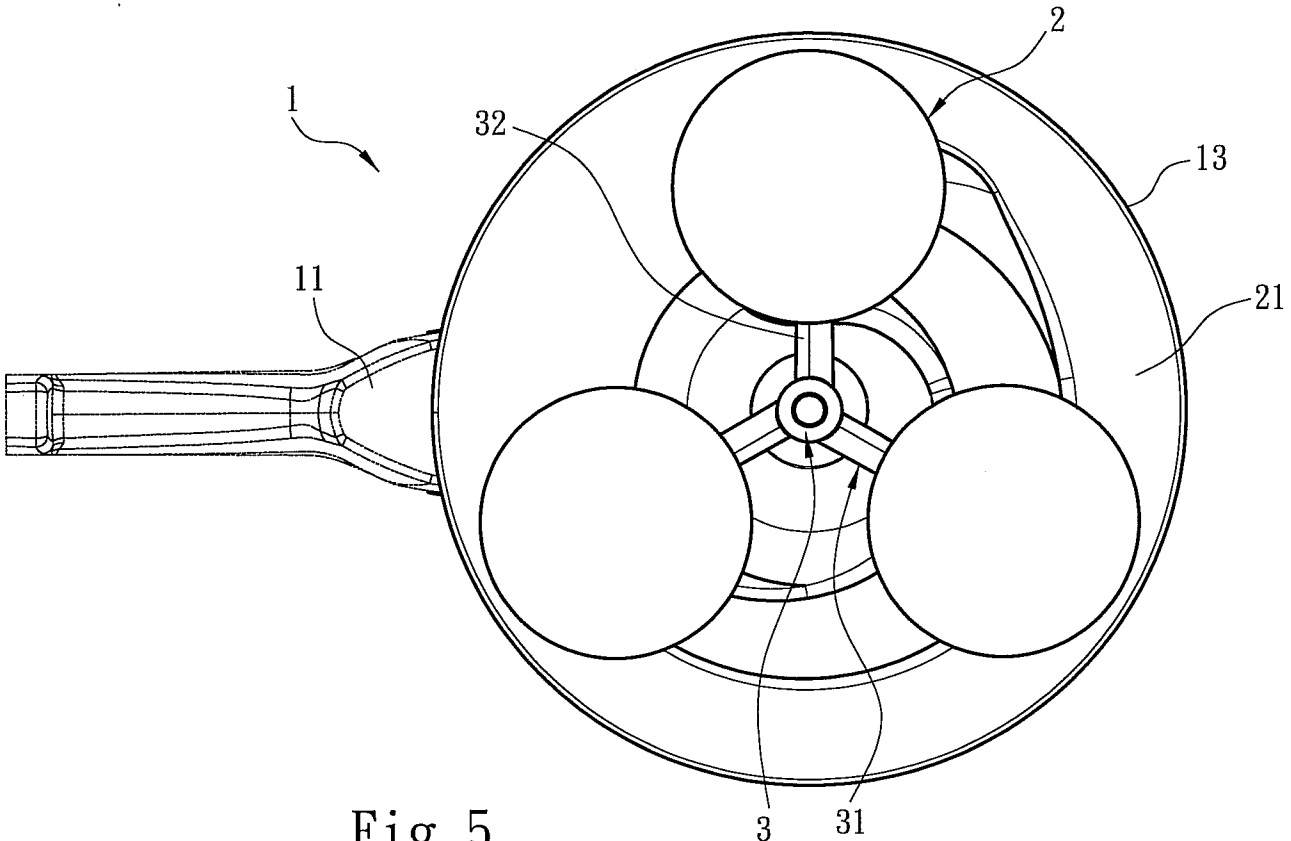
FIG. 5 is a schematic view of another embodiment of the invention

Please refer to FIG. 5 for another embodiment of the invention. It also has a plurality of grinding portions 2, but not limited to even number, and can be formed in an odd number. The connecting portions 31 coupled with the grinding portions 2 also are equally spaced from each other on the circumference formed by rotation of the rotary bracket 3. Similarly, the grinding portions 2 are driven by the driving motor 11 to rotate on a greater track to increase the grinding area at a faster grinding speed. Thus it has a higher grinding efficiency than the conventional grinding tools.

As the grinding portions 2 are driven by the spindle 12 to rotate and the grinding zones 21 also are driven to rotate synchronously to jointly form the grinding plane 4, a larger grinding area can be achieved. With the grinding portions 2 formed at the same weight and size and spaced from the spinning center at the same distance, the grinding portions 2 become balance weights relative to each other, thus the machine tool can operate smoothly in a balanced manner. Moreover, because the grinding portions 2 are spaced from the spinning center at a distance much greater than that of the conventional grinding tools, the invention can provide higher grinding speed and increase grinding efficiency.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A machine tool providing a large grinding area, comprising:

a tool body including a driving motor and a spindle connected to the driving motor and driven by the driving motor to spin axially;

a rotary bracket which is coupled to and driven by the spindle and includes a plurality of connecting portions equally spaced from each other on the circumference formed by rotation of the rotary bracket and an inclined vane set located on each of the plurality of connecting portions to blow dust upward during grinding; and a plurality of grinding portions which are coupled to the plurality of connecting portions without contacting to each other, wherein each of the plurality of grinding portions includes a grinding zones and all the grinding zones are located at the same horizontal level, and wherein the plurality of grinding zones are driven by the rotary bracket to rotate synchronously therewith to jointly form a grinding plane.

2. The machine tool of claim 1, wherein the tool body includes a hood to cover the grinding portions.

3. The machine tool of claim 2, wherein the hood includes a dust discharge port.

4. The machine tool of claim 1, wherein the rotary bracket includes a vane set located on each of the plurality of connecting portions.

5. The machine tool of claim 1, wherein the spindle includes a first coupling portion and the rotary bracket includes a second coupling portion fastened to the first coupling portion.

6. The machine tool of claim 5, wherein the first coupling portion and the second coupling portion are mating thread structures.

7. The machine tool of claim 1, wherein the grinding portions are formed at the same diameter.

8. The machine tool of claim 1, wherein the grinding portions are formed at the same weight.

9. The machine tool of claim 1, wherein each of the plurality of grinding portions includes a sandpaper on each of the grinding zones.

* * * * *